US008680957B2

(12) United States Patent
Kato

(10) Patent No.: US 8,680,957 B2
(45) Date of Patent: Mar. 25, 2014

(54) ELECTROMAGNETIC RELAY

(75) Inventor: Yoshimasa Kato, Mie (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/882,917

(22) PCT Filed: Oct. 14, 2011

(86) PCT No.: PCT/JP2011/073641
§ 371 (c)(1),
(2), (4) Date: May 1, 2013

(87) PCT Pub. No.: WO2012/063597
PCT Pub. Date: May 18, 2012

(65) Prior Publication Data

US 2013/0222086 A1 Aug. 29, 2013

(30) Foreign Application Priority Data

Nov. 8, 2010 (JP) ..... 2010-249967

(51) Int. Cl.
*H01H 13/04* (2006.01)
*H01H 9/02* (2006.01)

(52) U.S. Cl.
USPC ..... 335/202; 335/78

(58) Field of Classification Search
USPC ..... 335/78–86, 202
See application file for complete search history.

(56) References Cited

U.S. PATENT DOCUMENTS 5,696,475 A * 12/1997 Yoshitani et al. ..... 335/78
2006/0279384 A1 12/2006 Takayama et al.

FOREIGN PATENT DOCUMENTS

JP 8-222110 A 8/1996
JP 9-97550 A 4/1997
JP 11-213838 A 8/1999
JP 2006-344397 A 12/2006

OTHER PUBLICATIONS

International Search Report issued in International Patent Application No. PCT/JP2011/073641 mailed on Nov. 15, 2011.

* cited by examiner

*Primary Examiner* — Ramon Barrera
(74) *Attorney, Agent, or Firm* — McDermott Will & Emery LLP

(57) ABSTRACT

An electromagnetic relay (1) is formed by assembling a drive part (30), mobile body (50) that moves when the drive part (30) is driven, and a plurality of contact mechanisms (60, 70) that switch the contact and separation of contacts (61*d*, 62*d*, 71*d*, 72*d*) by the movement of the mobile body (50) in a body (40). Furthermore, a partition wall (21) is provided inside a case (20), which is fitted over the body (40), and a latching part (42) is provided in a location on the body (40) corresponding to the partition wall (21). In the state where the case (20) is fitted over the body (40), the front end of the partition wall (21) is latched to the latching part (42).

5 Claims, 7 Drawing Sheets

ELECTROMAGNETIC RELAY

RELATED APPLICATIONS

This application is the U.S. National Phase under 35 U.S.C. §371 of International Application No. PCT/JP2011/073641, filed on Oct. 14, 2011, which in turn claims the benefit of Japanese Application No. 2010-249967, filed on Nov. 8, 2010, the disclosures of which Applications are incorporated by reference herein.

TECHNICAL FIELD

The present invention relates to an electromagnetic relay.

BACKGROUND ART

Conventionally, as an electromagnetic relay, one is known in which a case is fitted over a body on which contact point mechanisms and an electromagnetic device are assembled (for example, refer to Patent Literature 1).

CITATION LIST

Patent Literature

Patent Document 1: Japanese Unexamined Patent Application Publication No. 2006-344397

SUMMARY OF INVENTION

However, in the above conventional art, the case and the body are fixed to each other by bonding the peripheral portion thereof only. Accordingly, there have been cases in which the body becomes warped or deformed due to a surrounding temperature change when curing a bonding agent and so on.

In consideration of the above, it is an object of the present invention to provide an electromagnetic relay in which a body can be suppressed from being warped or deformed.

An electromagnetic relay according to a first aspect of the present invention includes: a body with a drive part, a mobile body that moves upon driving of the drive part, and a plurality of contact point mechanisms of which contact points switch between contact and separation states assembled thereon; and a case which is fitted over the body. Partition walls are provided inside the case and latching parts are provided on the body at positions corresponding to those of the partition walls, and a tip end of each partition wall is latched to each latching part in a state where the case is fitted over the body.

In the electromagnetic relay according to a second aspect of the present invention, the tip end of the partition wall and the latching part is latched together with a bonding agent interposed therebetween.

In the electromagnetic relay according to a third aspect of the present invention, the plurality of contact point mechanisms are, respectively, partitioned by the partition walls in a state where the case is fitted over the body.

In the electromagnetic relay according to a fourth aspect of the present invention, the latching part has a through hole for introducing the bonding agent, and a regulation part for regulating movement of the bonding agent is formed between the latching part and the partition wall.

In the electromagnetic relay according to a fifth aspect of the present invention, the latching part has a groove part into which the tip end of the partition wall is inserted, and the tip end of the partition wall is latched in the groove part.

In the electromagnetic relay according to a sixth aspect of the present invention, the groove part has an opening formed therein that opens to a side portion of the body.

Advantageous Effects of Invention

According to the present invention, the partition walls are provided inside the case and the latching parts are provided on the body at positions corresponding to the partition walls, so that the tip end of each partition wall is latched onto the latching part. By latching the partition wall provided inside the case onto the body in this manner, the body can be suppressed from being warped or deformed due to the surrounding temperature change.

DESCRIPTION OF EMBODIMENTS

Figure 1:
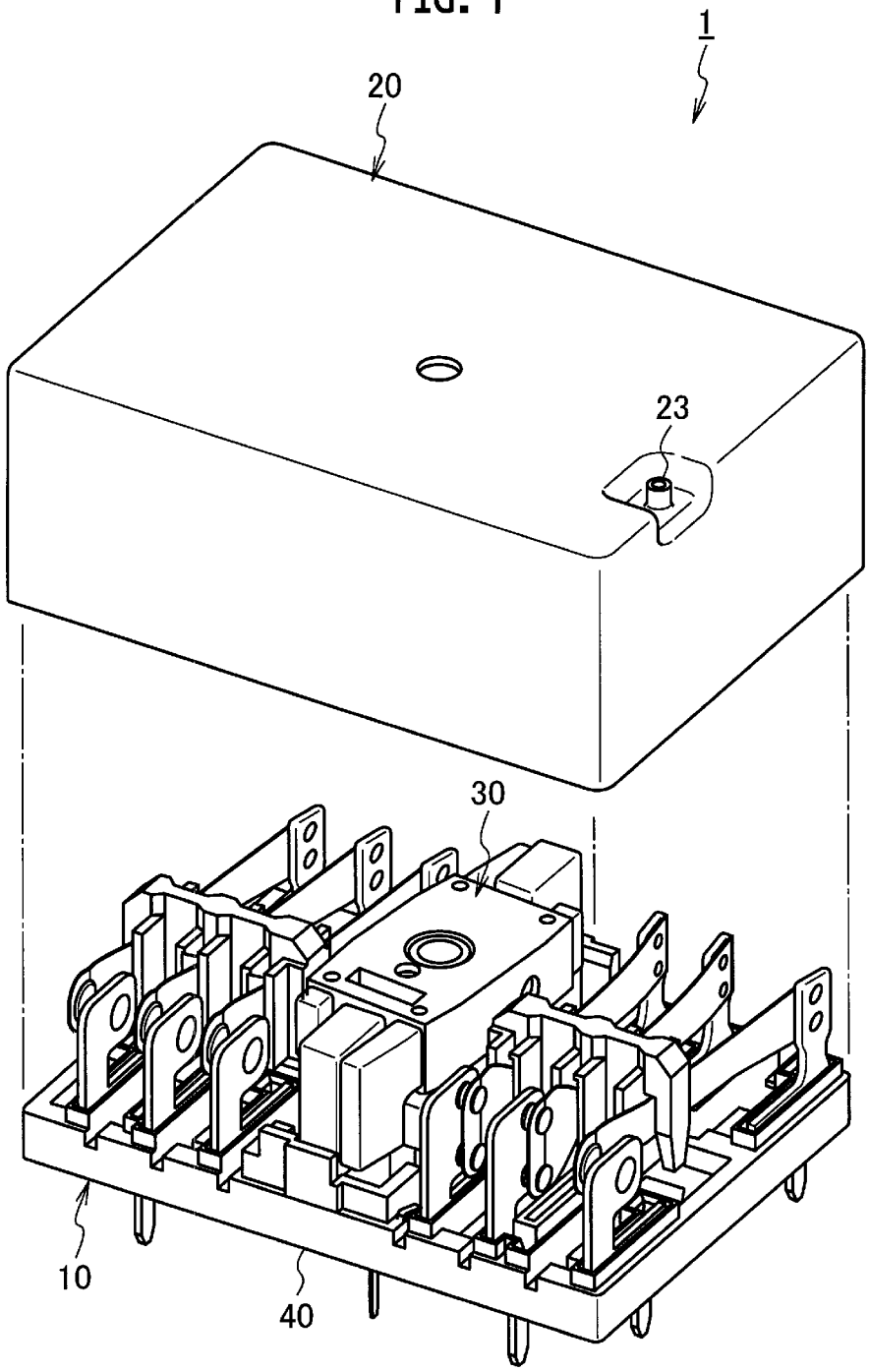
FIG. 1 is a perspective view showing an electromagnetic relay according to an embodiment of the present invention in a partially exploded manner.
Figure 2:
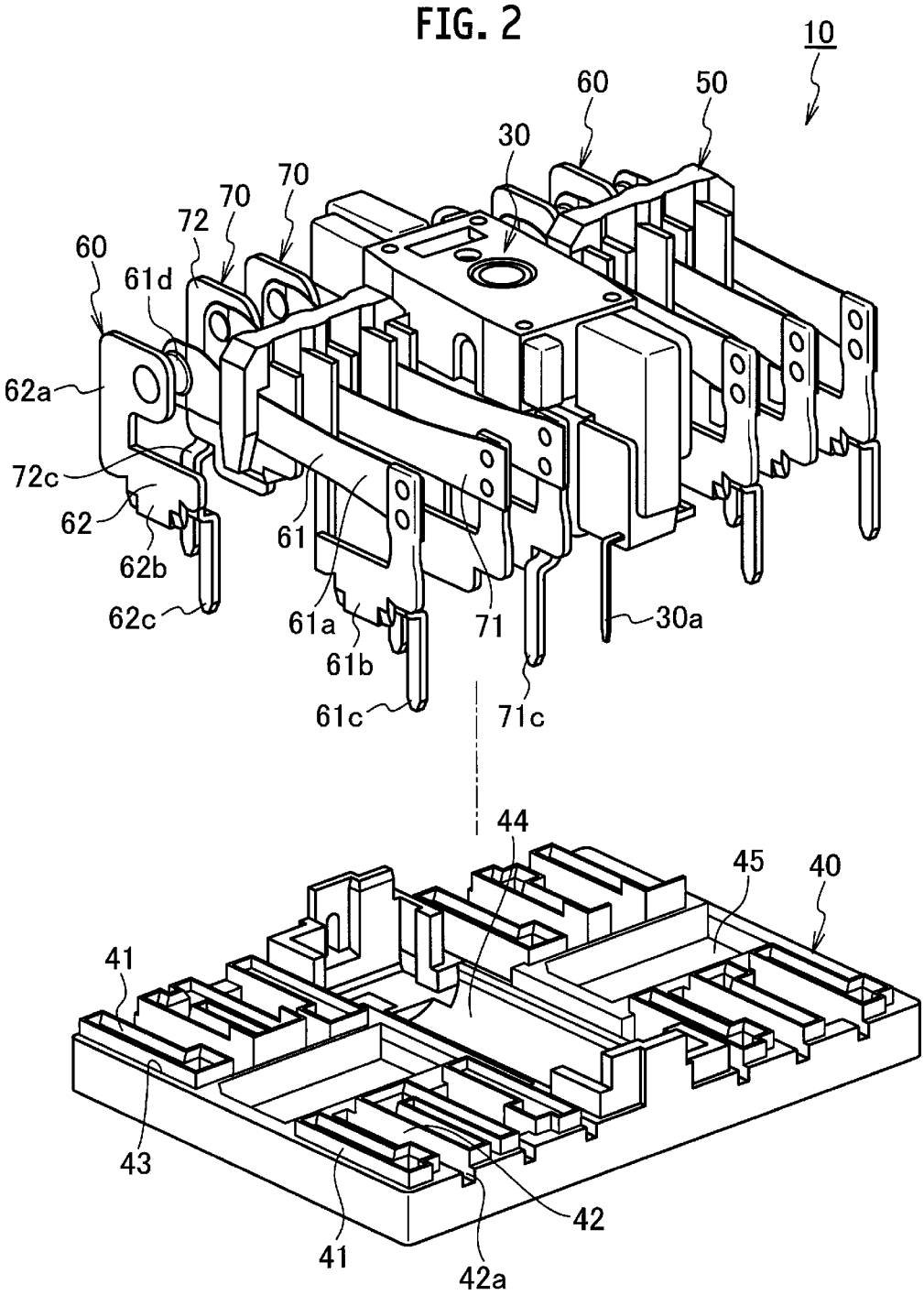
FIG. 2 is a perspective view showing a main body part of the electromagnetic relay according to the embodiment of the present invention in a partially exploded manner.

Hereinafter, a detailed description is made of an electromagnetic relay according to an embodiment of the present invention.

An electromagnetic relay 1 according to this embodiment is formed into a substantially box-shape by covering an electromagnetic relay main body part 10 with a case 20 from the above and then bonding and fixing the case 20 onto the body 40.

The electromagnetic relay main body part 10 is formed by assembling thereon an electromagnetic device (drive part) 30 and a plurality of contact point mechanisms 60, 70.

Specifically, the electromagnetic relay main body part 10 is formed by assembling the electromagnetic device 30 on the longitudinal center portion of the body 40 and the plurality of contact point mechanisms 60, 70 on both sides (three on each side in this embodiment) in the longitudinal direction of the body 40 (both end sides of the electromagnetic device 30), and clamping later-described movable contact point parts 61, 71 of the respective contact point mechanisms 60, 70 with a card (mobile body) 50.

Thereafter, the power is switched on to drive the electromagnetic device (drive part) 30 and to transmit the driving force to the cards 50, so that the plurality of contact point mechanisms can be switched between an open state and a closed state.

A publicly known one can be used as the electromagnetic device (drive part) 30, which can be configured by, for example, a permanent magnet, a yoke, an armature, a movable spring and a coil. The electromagnetic device thus configured enables the armature to be moved upon powering up the coil, and with the movement of the armature, enables the cards 50 to be moved along the longitudinal direction of the body 40.

Further, the electromagnet device 30 is provided with substrate connecting terminals 30*a* to be connected to a not-shown substrate. Each substrate connecting terminal 30*a* is inserted through a terminal insertion hole 44*a* formed on a recessed part 44 for mounting the electromagnetic device (drive part) of the body 40 and is pressed in so that each terminal 30*a* is protruded out of the lower surface side of the body 40. By this, the electromagnetic device 30 is assembled on the longitudinal center portion of the body 40.

Further, on the both end portions in the longitudinal direction of the substantially rectangular body 40, a plurality of silt holes 41 for fixing the contact point mechanisms are formed in an extending manner in the transverse direction, and between the adjacent slits 41 in the longitudinal direction of the body 40, a slit 42 (latching part: groove) is formed into which a tip end of a later-described partition wall 21 of the case 20 is inserted.

Still further, an outer peripheral groove 43 for bonding the case 20 is formed on the outer peripheral portion of the body 40. By fitting an outer peripheral part 20*a* of the case 20 over this outer peripheral groove 43, the case 20 is fitted over and mounted on the body 40.

Then, on transverse center portions of the body 40 which are on both sides of the recessed part 44 for mounting the electromagnetic device (drive part), guide recessions 45 extending in the longitudinal direction of the body 40 are respectively formed. This enables the tip end of each card 50 to move within each guide recession 45 while being guided.

Additionally, the plurality of contact point mechanisms 60, 70 are, respectively, provided with the movable contact point parts 61, 71 and fixed contact point parts 62, 72.

The movable contact point part 61 is configured to include a sheeted leaf spring 61*a* which is clamped by the card 50, a fixed plate 61*b* which is attached to a base portion of the leaf spring 61*a*, a substrate connecting terminal 61*c* which is provided on the fixed plate 61*b*, and the movable contact point 61*d* which is provided at a tip end portion of the leaf spring 61*a*.

Meanwhile, the fixed contact point part 62 is configured to include an upper fixed plate 62*a*, a lower fixed plate 62*b*, a substrate connecting terminal 62*c* which is provided on the lower fixed plate 62*b*, and the fixed contact point 62*d* which is provided on the upper fixed plate 62*a* and can be contacted with and separated from the movable contact point 61*d*.

Further, the movable contact point part 71 is configured to include a sheeted leaf spring 71*a* which is clamped by the card 50, a fixed plate 71*b* which is attached to a base portion of the leaf spring 71*a*, a substrate connecting terminal 71*c* which is provided on the fixed plate 71*b*, and the movable contact point 71*d* which is provided at a tip end portion of the leaf spring 71*a*.

Meanwhile, the fixed contact point part 72 is configured to include an upper fixed plate 72*a*, a lower fixed plate 72*b*, a substrate connecting terminal 72*c* which is provided on the lower fixed plate 72*b*, and the fixed contact points 72*d* which are provided on the upper fixed plate 72*a* and can be contacted with and separated from the movable contact points 71*d*.

Then, each of the terminals 61*c*, 62*c*, 71*c* and 72*c* is inserted through the slit hole 41 in a protruding manner from the lower surface side of the body 40, and the movable contact point parts 61, 71 and the fixed contact point parts 62, 72 are pressed into the respective slit holes 41 so that the movable contact point parts 61, 71 and the fixed contact point parts 62, 72 are assembled on the body 40.

Here, in this embodiment, each of the movable contact point part 61 and the fixed contact point part 62 of the contact point mechanism 60 is provided with a single contact point which is the contact point 61*d* and the contact point 62*d*, respectively.

Moreover, the movable contact point part 71 is provided with two contact points 71*d*, and the fixed contact point part 72 of the contact point mechanism 70 is provided with two contact points 72*d*. In this embodiment, the vertically arranged two contact points 71*d*, 71*d* of the movable contact point part 71 and the vertically arranged two contact points 72*d*, 72*d* of the fixed contact point part 72 are arranged in parallel to each other. When the upper contact points 71*d* and 72*d* come into contact with each other, the lower contact points 71*d* and 72*d* also come into contact with each other.

As described above, the electromagnetic relay 1 according to this embodiment includes at least one contact point mechanism 60 in which the movable contact point part 61 and the fixed contact point part 62, respectively, have one contact point 61*d* and one contact point 62*d*, and also includes at least one contact point mechanism 70 in which at least one of the movable contact point part 71 and the fixed contact point part 72 (both in this embodiment) has a plurality (two) of contact points which are the contact points 71*d* and 72*d*, respectively. By configuring in this manner, reliability of the contact points are improved and cost can be reduced.

Figure 3:
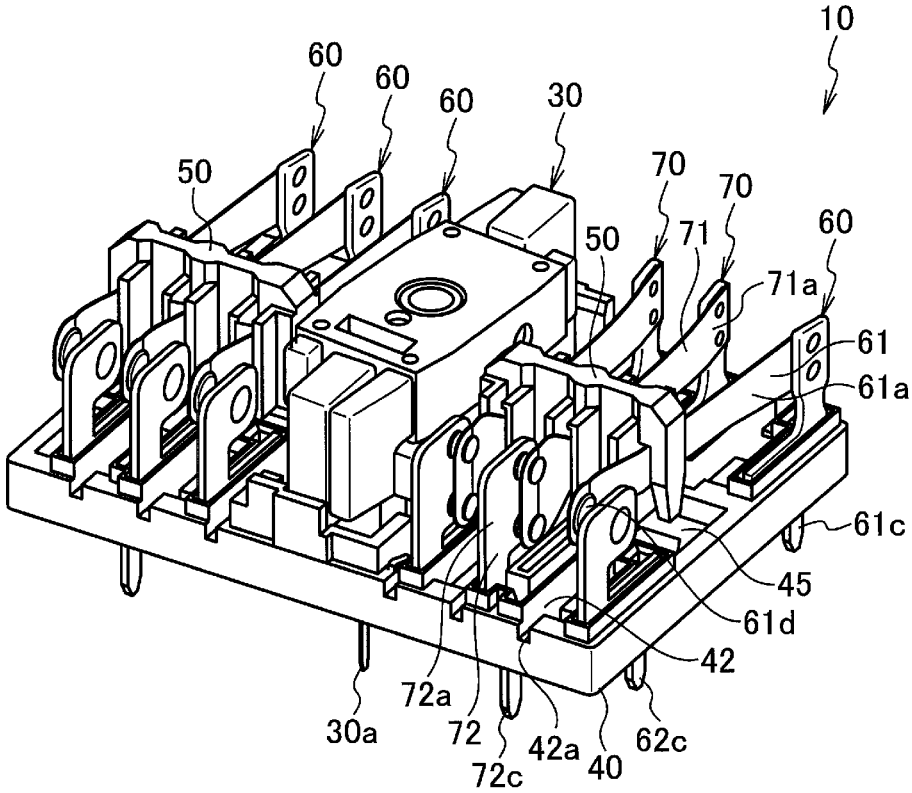
FIG. 3 is a perspective view showing the main body part of the electromagnetic relay according to the embodiment of the present invention.
Figure 6:
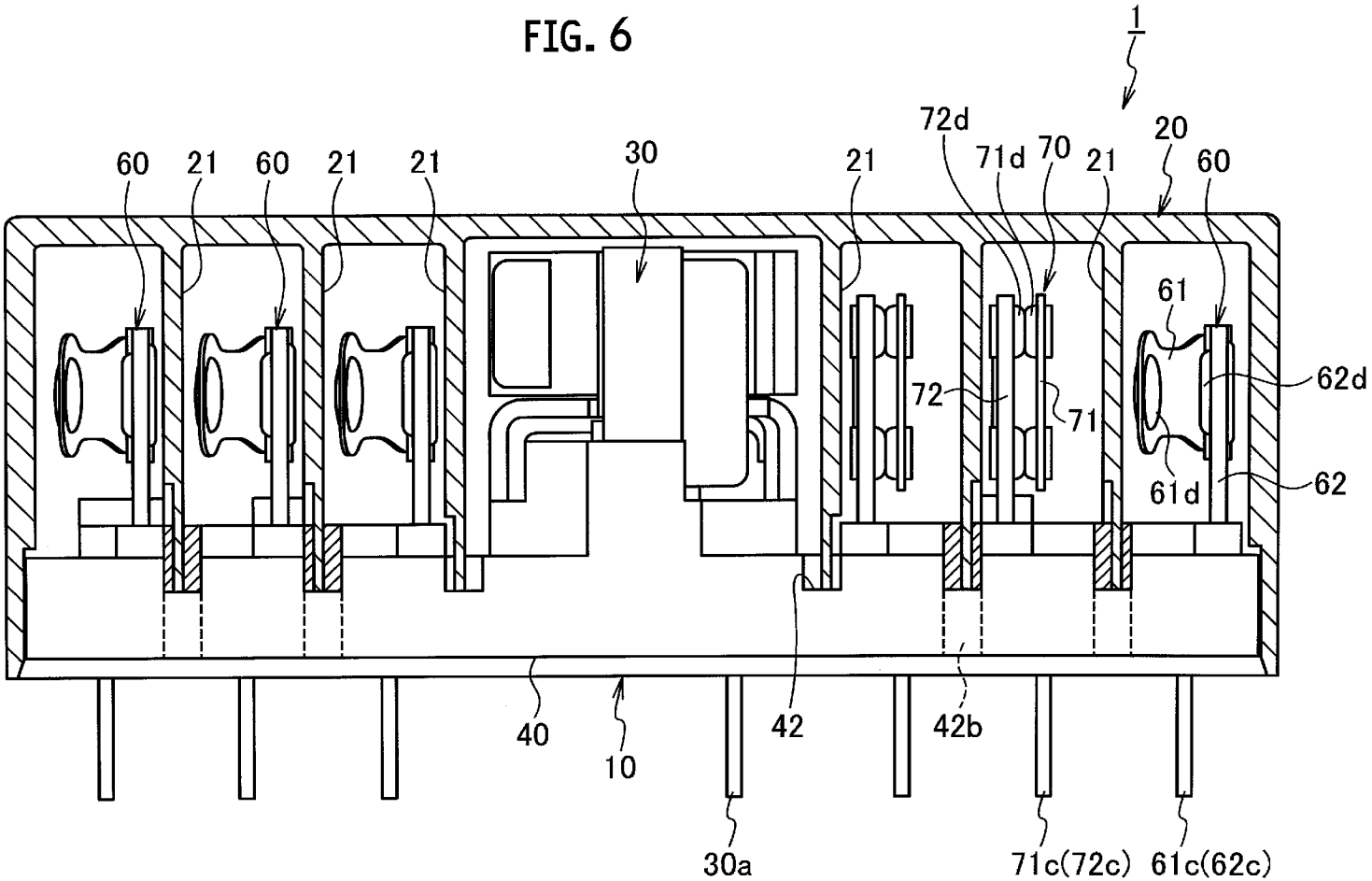
FIG. 6 is a longitudinal cross-sectional view schematically showing the electromagnetic relay according to the embodiment of the present invention.

Further, in this embodiment, as shown in FIGS. 3 and 6, the contact point mechanism 70 (one having the plurality of contact points) is configured as a normally-closed contact point. In other words, the contact point mechanism 70 (one having the plurality of contact points) is configured so that, when the electromagnetic device (drive part) 30 is not excited, the contact points 71*d* and 72*d* are in contact with each other, and upon excitation of the electromagnetic device (drive part) 30, the contact points 71*d* and 72*d* become separated.

As described above, the contact reliability is further improved by using the contact point mechanism 70 (one having the plurality of contact points) which has higher contact reliability than the contact point mechanism 60 (one having only the single contact point) as the normally-closed contact point from which foreign object adhered to is difficult to be removed.

On the other hand, the contact point mechanism 60 (one having only the single contact point) is configured as a normally-opened contact point. In other words, the contact point mechanism 60 (one having the single contact point) is configured so that, when the electromagnetic device (drive part) 30 is not excited, the contact points 61*d*, 62*d* are separated from each other, and upon excitation of the electromagnetic device (drive part) 30, the contact points 61*d* and 62*d* are brought into contact with each other.

Further, in this embodiment, as shown in FIG. 6, the contact point mechanisms are arranged from the electromagnetic device (drive part) 30 towards the right side, in the order of the contact point mechanism 70 as the normally-closed contact point, the contact point mechanism as the normally-closed contact point and the contact point 60 as the normally-opened contact point, and from the electromagnetic device (drive part) 30 towards the left side, three contact point mechanisms 60 as the normally-opened contact points are arranged.

Thus, by configuring the electromagnetic relay 1 as a multipolar electromagnetic relay as above, one electromagnetic relay can be applied to various circuits. Accordingly, the electromagnetic relay can be used as a signal controlling electromagnetic relay, a high current controlling electromagnetic relay and the like, according to various purposes.

The case 20 has a substantially box-like shape with an opened lower portion to cover the body 40 from above in a state where the electromagnetic device (drive part) 30 and the contact point mechanisms 60, 70 are assembled on the body 40. In this embodiment, the outer peripheral part 20*a* of the case 20 is bonded to the outer peripheral groove 43 by a bonding agent to fit the case 20 over the body 40. In addition, a reference numeral 23 of FIG. 1 is an air escape hole for preventing the pressure inside from becoming high upon bonding and curing the case 20.

Figure 4:
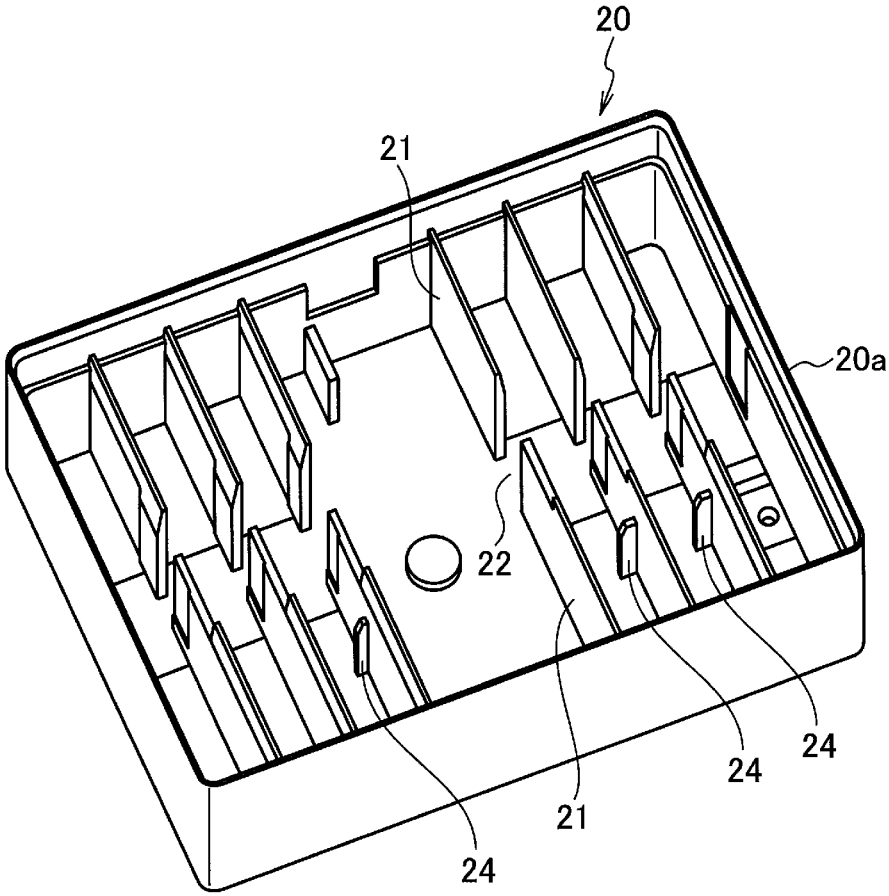
FIG. 4 is a perspective view showing an inner side of a case of the electromagnetic relay according to the embodiment of the present invention.

In this embodiment, the case 20 is provided with the partition walls 21 therein. Specifically, three (plural) transversely extended partition walls are arranged in parallel in the longitudinal direction inside the case 20. Further, at a transverse center portion of each partition wall 21, a space part 22 is formed for allowing movement of the card 50. In other words, six partition walls 21 are arranged in parallel, respectively, on one side and the other side in the transverse direction. Note that reference numerals 24 in FIG. 4 are wall parts for reinforcing the later-described partition walls 21 and for restricting a movable region of the contact point mechanisms 60, 70.

Further, the latching parts are provided on the body at positions corresponding to those of the partition walls 21. And the tip end portion of each partition wall 21 is latched to the latching part in a state where the case 20 is fitted over the body 40.

In this embodiment, the latching part is configured to include a slit (groove part) 42 into which the tip end of the partition wall 21 of the case 20 is inserted, and a through hole 42*b* for introducing the bonding agent which is formed in the slit 42 so as to penetrate to the rear surface side of the body 40.

Further, the tip end of the partition wall 21 and the latching part is latched by the bonding agent. In other words, when fitting the case 20 over the body 40, the tip end of the partition wall 21 of the case 20 is made to be inserted into the slit 42 and, in this state, the bonding agent is introduced into the slit 42 through the through hole 42*b* from the rear surface side of the body 40, thereby bonding and fixing the tip end of the partition wall 21 and the latching part together.

By bonding and fixing the tip end of the partition wall 21 and the latching part as described above, the case 20 and the body 40 are prevented from warping and deforming due to expansion upon heating and contraction upon cooling of the electromagnetic relay 1 when bonding and solidifying (thermal curing) the case 20 to the body 40.

Still further, in this embodiment, a regulation part is formed between the slit (latching part) 42 and the partition wall 21, for regulating movement of the bonding agent.

Figure 7:
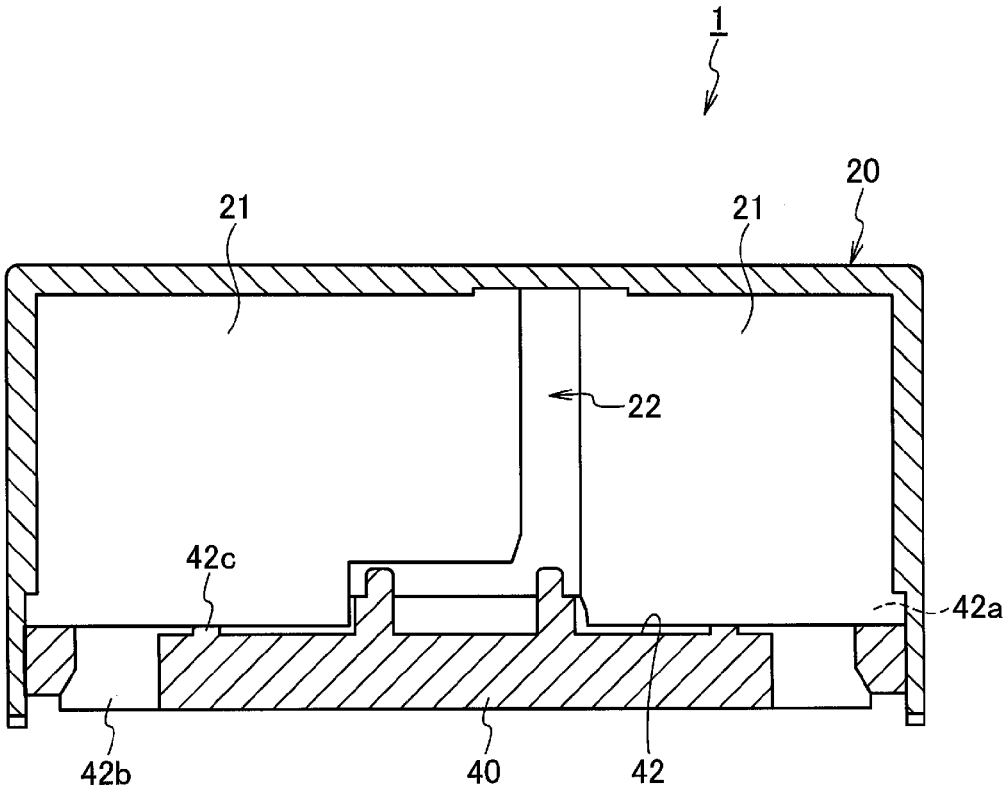
FIG. 7 is a transverse cross-sectional view schematically showing the electromagnetic relay according to the embodiment of the present invention.

Specifically, as shown in FIG. 7, a protrusion (regulation part) 42*c* is arranged to be closer to the transverse center side of the body 40 than the through hole 42*b* of the slit 42, and this protrusion 42*c* regulates the bonding agent not to flow inside of the protrusion 42*c* in the transverse direction. Suppressing the bonding agent from flowing towards the transverse center side of the body 40 can suppress the bonding agent from inhibiting movement of the card 50 and the like.

Further, in this embodiment, the plurality of contact point mechanisms 60, 70 are partitioned by the partition walls 21 in a state where the case 20 is fitted over the body 40.

In other words, each partition wall 21 is functioned to partition each of the contact point mechanisms 60, 70 from the others. By partitioning each of the contact point mechanisms 60, 70 from the others, each of the contact point mechanisms 60, 70 is insulated. This means, in this embodiment, the partition wall 21 also functions as an insulating member. In addition, in this embodiment, the partition wall is formed so that the tip end portion thereof becomes thin. This facilitates insertion of the partition wall 21 into the slit 42, while improving insulation strength of each of the contact point mechanisms 60, 70.

Figure 5:
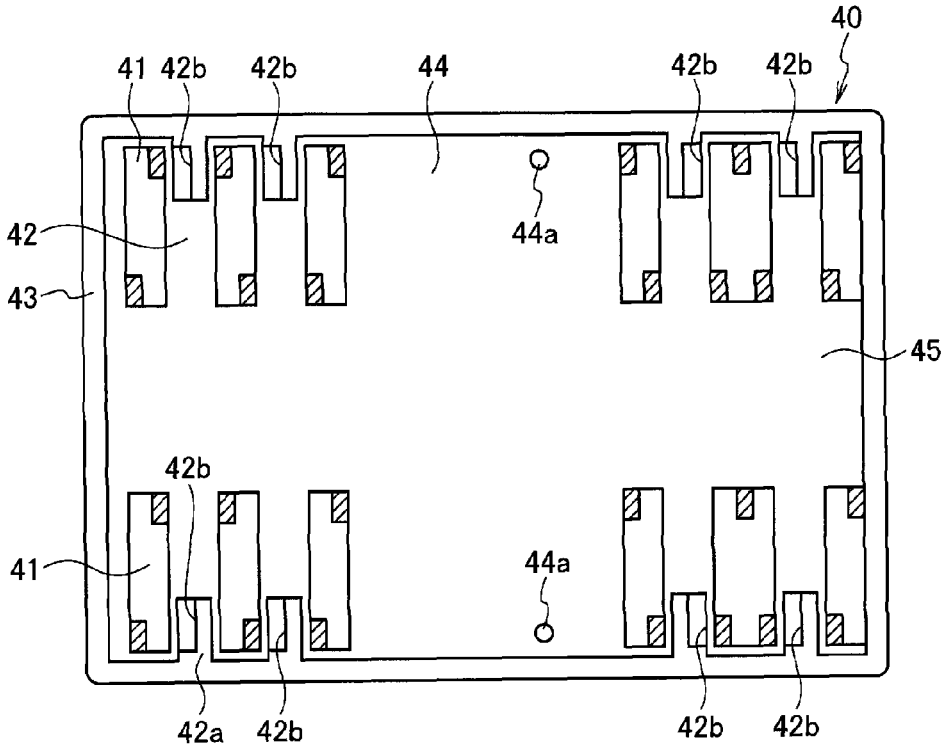
FIG. 5 is a plan view schematically showing a base of the electromagnetic relay according to the embodiment of the present invention.

Still further, in this embodiment, as shown in FIGS. 3 and 5, an opening part 42*a* is formed in each slit 42, which opens to the side portion of the body 40. By forming the opening part 42*a* in the slit 42, the bonding agent used for bonding the outer peripheral part 20*a* of the case 20 to the outer peripheral groove 43 permeates into the slit 42 to further improve durability (strength and heat resistance) of the relay 1.

As described above, in this embodiment, the partition walls 21 are provided inside the case 20 while the tip end portion of each partition wall 21 is latched onto the body 40.

In particular, in this embodiment, the tip end portion of the partition wall 21 is latched onto the body 40 by introducing the bonding agent from the through hole 42*b*.

Accordingly, when bonding and solidifying (heat curing) the case 20 to the body 40, the case 20 and the body 40 can be suppressed from warping and deforming due to expansion upon heating and contraction upon cooling of the electromagnetic relay 1.

In other words, like the conventional case in which the case 20 and the body 40 are fixed by bonding only the peripheral portions, the body 40 may possibly warp or deform. This causes assembled positions of the contact point mechanisms and electromagnetic device on the body 40 to become shifted, thereby to give great influence on characteristic change of the relay.

However, according to this embodiment, the body 40 can be suppressed from becoming warped or deformed. Therefore, characteristic of the relay can be suppressed from changing when bonding and solidifying (attaching the case 20 to the body 40). Also, by providing the partition walls 21 and latching each partition wall 21 to the latching part provided on the body 40, the durability (strength and heat resistance) of the relay 1 can be improved.

Further, according to this embodiment, the contact point mechanisms 60, 70 are configured to separate from each other by the partition walls 21, allowing each of the contact point mechanisms 60, 70 to be insulated from the others.

Further, according to this embodiment, the latching part has the slit (groove part) 42 into which the tip end of the partition wall 21 is inserted, and the slit (groove part) 42 causes the tip end of the partition wall 21 to be latched therein. Accordingly, the slit (groove part) 42 positions the partition wall 21 so as to bond (latch) the partition wall 21 more securely and also to improve the durability (strength and heat resistance) of the relay 1 even more.

In addition, according to this embodiment, the protrusion (regulation part) 42*c* is provided between the slit (latching part) 42 and the partition wall 21, for regulating the movement of the bonding agent. Consequently, the bonding agent can be suppressed from flowing inside the slit (latching part) 42, and as a result, the movement of the card 50 and the like do not become inhibited by the bonding agent. In other words, the protrusion 42*c* can suppress degradation in performance of the electromagnetic relay 1 due to the bonding agent.

Further, according to this embodiment, the opening parts 42*a* are formed to open on the side portion of the body 40.

Therefore, the bonding agent used for bonding the outer peripheral part 20*a* of the case 20 to the outer peripheral groove 43 can be permeated into the slit 42, improving the durability (strength and heat resistance) of the relay 1 even more.

The preferred embodiment of the present invention is described hereinabove; however, the present invention is not limited to the above embodiment and various modifications can be made.

For example, in each embodiment, the plurality of contact point mechanisms are arranged in parallel on both sides of the drive part in the above embodiment; however, the plurality of contact mechanisms can be arranged on one side of the drive part.

Moreover, the movable spring, the contact points and other detailed specifications (such as shape, size and layout) can be changed as appropriate.

INDUSTRIAL APPLICABILITY

According to the present invention, the electromagnetic relay is provided, in which the body can be suppressed from being deformed or warped.

The invention claimed is:

1. An electromagnetic relay comprising:

a body formed by assembling thereon a drive part, a mobile body that moves upon driving of the drive part, and a plurality of contact point mechanisms of which contact points switch between contact and separation states; and a case which is fitted over the body, wherein partition walls are provided inside the case and latching parts are provided on the body at positions corresponding to those of the partition walls, a tip end of each partition wall is latched onto each latching part in a state where the case is fitted over the body, wherein the tip end of the partition wall and the latching part is latched together with a bonding agent interposed therebetween, and a protrusion as a regulation part for regulating movement of the bonding agent is formed between the latching part and the partition wall.

2. The electromagnetic relay according to claim 1, wherein the plurality of contact point mechanisms are, respectively, partitioned by the partition walls in a state where the case is fitted over the body.

3. The electromagnetic relay according to claim 1, wherein the latching part has a through hole for introducing the bonding agent.

4. The electromagnetic relay according to claim 1, wherein the latching part has a groove part into which the tip end of the partition wall is inserted, and the tip end of the partition wall is latched in the groove part.

5. The electromagnetic relay according to claim 4, wherein the groove part has an opening formed therein that opens to a side portion of the body.

* * * * *